US012606965B2

(12) United States Patent
Xu et al.

(10) Patent No.: US 12,606,965 B2
(45) Date of Patent: Apr. 21, 2026

(54) ROAD PAVER

(71) Applicant: Ningbo Roaby Technology Industrial Group Co., Ltd., Ningbo (CN)

(72) Inventors: Bin Xu, Ningbo (CN); Su Xu, Ningbo (CN); Qi You, Ningbo (CN); Jianhua Lyu, Ningbo (CN); Zhengwu Liu, Ningbo (CN); Yi Wang, Ningbo (CN); Yu Zhang, Ningbo (CN)

(73) Assignee: NINGBO ROABY TECHNOLOGY INDUSTRIAL GROUP CO., LTD., Ningbo (CN)

( * ) Notice: Subject to any disclaimer, the term of this patent is extended or adjusted under 35 U.S.C. 154(b) by 719 days.

(21) Appl. No.: 17/991,812

(22) Filed: Nov. 21, 2022

(65) Prior Publication Data

US 2023/0160151 A1 May 25, 2023

(30) Foreign Application Priority Data

Nov. 22, 2021 (CN) ..... 202111383600.7

(51) Int. Cl.
*E01C 19/00* (2006.01)

(52) U.S. Cl.
CPC ..... *E01C 19/002* (2013.01); *E01C 2301/02* (2013.01)

(58) Field of Classification Search
CPC .... E01C 19/002; E01C 19/466; E01C 19/185; E01C 19/2025; E01C 19/21; E01C 19/475; E01C 19/4846; E01C 2019/2065; E01C 2019/609; E01C 2301/02
See application file for complete search history.

(56) References Cited

U.S. PATENT DOCUMENTS

| | | | | |
|---|---|---|---|---|
| 3,540,359 | A * | 11/1970 | Swisher, Jr. | E01C 19/185 404/110 |
| 5,069,578 | A * | 12/1991 | Bense | E01C 11/005 404/75 |
| 5,895,173 | A * | 4/1999 | O'Brien | E01C 19/21 404/110 |
| 9,109,332 | B1 * | 8/2015 | Stone, Jr. | E01C 23/06 |
| 10,808,368 | B2 * | 10/2020 | Rainwater | B05B 13/005 |
| 11,008,712 | B1 * | 5/2021 | Scigliano | E01C 19/203 |
| 2012/0068381 | A1 * | 3/2012 | Troke | B28B 7/0064 264/319 |
| 2019/0127929 | A1 * | 5/2019 | Christian | E01C 19/174 |

FOREIGN PATENT DOCUMENTS

| | | | |
|---|---|---|---|
| CN | 208965374 U | * | 6/2019 |
| EP | 957204 A1 | * | 11/1999 |

* cited by examiner

*Primary Examiner* — Abigail A Risic
(74) *Attorney, Agent, or Firm* — MATTHIAS SCHOLL P.C.; Matthias Scholl

(57) ABSTRACT

A road paver includes: a head; a body including a front end and a tail end; a feeding device, disposed in the front end to convey polyurethane concrete, and the feeding device including a stirring device; a stone paving device, disposed on the tail end to spread crushed stone over a road, and the stone paving device including a stone feed bin carrying the crushed stone; and a concrete paving device, disposed between the feeding device and the stone paving device and connected to the stirring device, and used to spread the polyurethane concrete across the road.

8 Claims, 6 Drawing Sheets

ROAD PAVER

CROSS-REFERENCE TO RELATED APPLICATIONS

Pursuant to 35 U.S.C. § 119 and the Paris Convention Treaty, this application claims foreign priority to Chinese Patent Application No. 202111383600.7 filed Nov. 22, 2021, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to a road paver.

Conventional concrete mixer trucks stir and mix water and cement. In a road pavement process, a concrete mixer truck moves synchronously with concrete paving equipment to provide mixed concrete and complete the road pavement work. The synchronous movement of the concrete mixer truck and the concrete paving equipment occupies much road space, and the separate production, transportation, and pavement of concrete is inefficient and time-consuming, leading to high construction costs.

SUMMARY

The disclosure provides a road paver, comprising:

a head;

a body comprising a front end and a tail end;

a feeding device, disposed in the front end to convey polyurethane concrete, and the feeding device comprising a stirring device;

a stone paving device, disposed on the tail end to spread crushed stone over a road, and the stone paving device comprising a stone feed bin carrying the crushed stone; and a concrete paving device, disposed between the feeding device and the stone paving device and connected to the stirring device, and used to spread the polyurethane concrete across the road.

The road paver is used to spread the polyurethane concrete across the road and spread the crushed stone over the polyurethane concrete, thereby improving pavement performance. The feeding device is used to transport the polyurethane concrete to the stirring device. The stirring device is used to homogeneously mix the polyurethane concrete and transports it to the concrete paving device. The concrete paving device is used to spread the polyurethane concrete cross a road. The stone paving device is connected to the concrete paving device and used to spread the crushed stone over the polyurethane concrete road, thereby improving the pavement performance.

In a class of this embodiment, the stirring device comprises:

a housing, connected to the feeding device and used to receive the polyurethane concrete from the feeding device;

a rotating member, disposed in the housing;

at least two helical blades, used to stir and transport the polyurethane concrete;

a stirring member, disposed between the at least two helical blades to stir the polyurethane concrete;

the at least two helical blades and the stirring member are connected to the rotating member.

The stirring device is used to stir and transport the polyurethane concrete while preventing the polyurethane concrete from setting. The feeding device transports the polyurethane concrete to the stirring device; specifically, the polyurethane concrete is poured into the housing and homogeneously mixed. The rotating member is rotatable in the housing; the at least two helical blades are spaced apart on the rotating member; and the stirring member is disposed between the at least two helical blades. As the rotating member rotates, the at least two helical blades and the stirring member rotate as well and thoroughly mix the polyurethane concrete in the housing, thus preventing the polyurethane concrete from setting. The at least two helical blades comprises a helical structure used to direct the polyurethane concrete toward the concrete paving device, thus increasing the performance of the road paver.

In a class of this embodiment, the feeding device further comprises:

a power system on one side of the head of the road paver to power the feeding device;

a transmission system disposed on one side of the stirring device, and being driven by the power system to convey aggregates of the polyurethane concrete;

a collecting system, being connected to the stirring device and the transmission system and guiding the aggregates from the transmission system to the stirring device.

The feeding device is used to control the amount of the aggregate transported to the stirring device, thereby maintaining a certain polyurethane-to-aggregate ratio. The transmission device comprises a conveyor belt. When the power system is energized, the conveyor belt carries the aggregate to the stirring device. The "aggregate" as used herein refers to an irregular shaped material that is used with a polyurethane material to form the polyurethane concrete. The collecting system is used to transport a certain amount of the aggregate to the stirring device at a specific speed. The collecting system comprises two pipes through which a certain amount of polyurethane is added to the stirring device, so that the aggregate and polyurethane are mixed in a proper ratio.

In a class of this embodiment, the concrete paving device comprises:

a feed hopper, disposed below the stirring device to receive the polyurethane concrete from the stirring device;

a concrete feed bin connected to the feed hopper to hold the polyurethane concrete; and an unloading hopper, disposed below the concrete feed bin; the polyurethane concrete is laid down on the road via the unloading hopper.

The concrete paving device is used to spread the polyurethane concrete evenly across the road. Specifically, the polyurethane concrete is homogeneously mixed in the stirring device and poured into the concrete feed bin via the feed hopper. The polyurethane concrete is spread to fill width of the road and laid down on the road through the unloading hopper. The unloading hopper has a uniform cross section, so that a thickness of the polyurethane concrete is uniform.

In a class of this embodiment, the concrete paving device further comprises:

a screed, disposed on a rear end of the concrete paving device to flatten the polyurethane concrete; and a vibrator, disposed in front of the screed to compact the polyurethane concrete.

The concrete paving device is further used to flatten and compact the polyurethane concrete, which decreases air voids in the polyurethane concrete, thereby forming a stable subsurface.

In a class of this embodiment, the concrete paving device further comprises a screw conveyor disposed in the concrete feed bin to spread the polyurethane concrete across the road.

The polyurethane concrete is pushed toward both side of the screw conveyor, passed through the unloading hopper, and spread across the road, so that the air voids in the polyurethane concrete is decreased. The unloading hopper has sides that slope at an angle. The unloading hopper comprises a first baffle and a second baffle; the first baffle is close to the head and has a greater length than the second baffle; the screw conveyor comprises a bottom end disposed on the same level as the second baffle. The polyurethane concrete is pushed toward the both sides of the screw conveyor, passed through the first baffle, and laid down on the road to form a base layer; the polyurethane concrete is then passed through the second baffle and spread over the base layer. The polyurethane concrete is laid in two layers, which makes the thickness of the polyurethane concrete uniform and decreases the air voids in the polyurethane concrete.

In a class of this embodiment, the concrete paving device further comprises a road grader used to maintain a stable forward movement of the stone paving device.

The concrete paving device is further used to balance the paving device and flatten a road surface.

In a class of this embodiment, the stone paving device further comprises:

- a running gear, disposed at a bottom portion of the stone paving device to carry the stone paving device to move; and
- a speed sensor, disposed on the running gear to measure and adjust the operating speed of the running gear.

The operating speed of the running gear is adjusted to control the amount of the crushed stone required per square foot. The concrete paving device is detachably connected to the stone paving device; and the intensity of the crushed stone pavement is determined by the requirements of the road surface.

In a class of this embodiment, the stone paving device further comprises:

- a stone conveyor, disposed in the stone feed bin and used to drive the small rocks to move;
- a paving roller, disposed below the stone conveyor to spread the crushed stone into the polyurethane concrete; and
- a driving device, disposed on a frame of the stone paving device and connected to the paving roller to drive the rotation of the paving roller.

Both ends of the paving roller is connected to the concrete paving device to create an enclosed space; when the driving device is energized, the crushed stone is spread to fill width of the road by the stone conveyor, passed through the enclosed space, and laid down on the road through the paving roller, so that a thickness of the crushed stone is uniform.

In a class of this embodiment, the feeding device further comprises:

- a first measuring member, disposed between the power system and the transmission system to hold the aggregates; and the aggregates are transported into the stirring device through the transmission system;
- a second measuring member, disposed between the first measuring member and the power system and comprising at least two measuring boxes used to hold polyurethane; and a certain amount of polyurethane is poured into the stirring device under control of the at least two measuring boxes.

In a construction site, the first measuring member and the second measuring member are used to determine a ratio of components in the polyurethane concrete. The polyurethane concrete is sieved to a dense gradation level. A cement sand ratio of the polyurethane concrete is 15%-17%. The polyurethane concrete has a low porosity and an impermeability level of P12. The polyurethane concrete is suitable for use in the regions where road salt is used and coastal areas have a high content of chloride ions, because it has a chloride ion permeability rate of less than 100 coulombs (nearly 0) and is a waterproof and corrosion-resistant material. The polyurethane concrete has a maximum tensile strength of more than 5000 με at −20° C., indicating high flexibility and low-temperature crack resistance. The polyurethane concrete is a thermosetting material that does not melt under heat. In a rutting resistance test, the polyurethane concrete exhibits a dynamic stability of 23000 times/mm at 80° C., indicating high rutting resistance at high temperatures. At 70° C., the mechanical properties of polyurethane concrete remain unchanged. The polyurethane concrete has a linear expansion coefficient that is 1.1 to 1.3 times that of steel, and the shear force caused by temperature is moderate.

Figure 1:
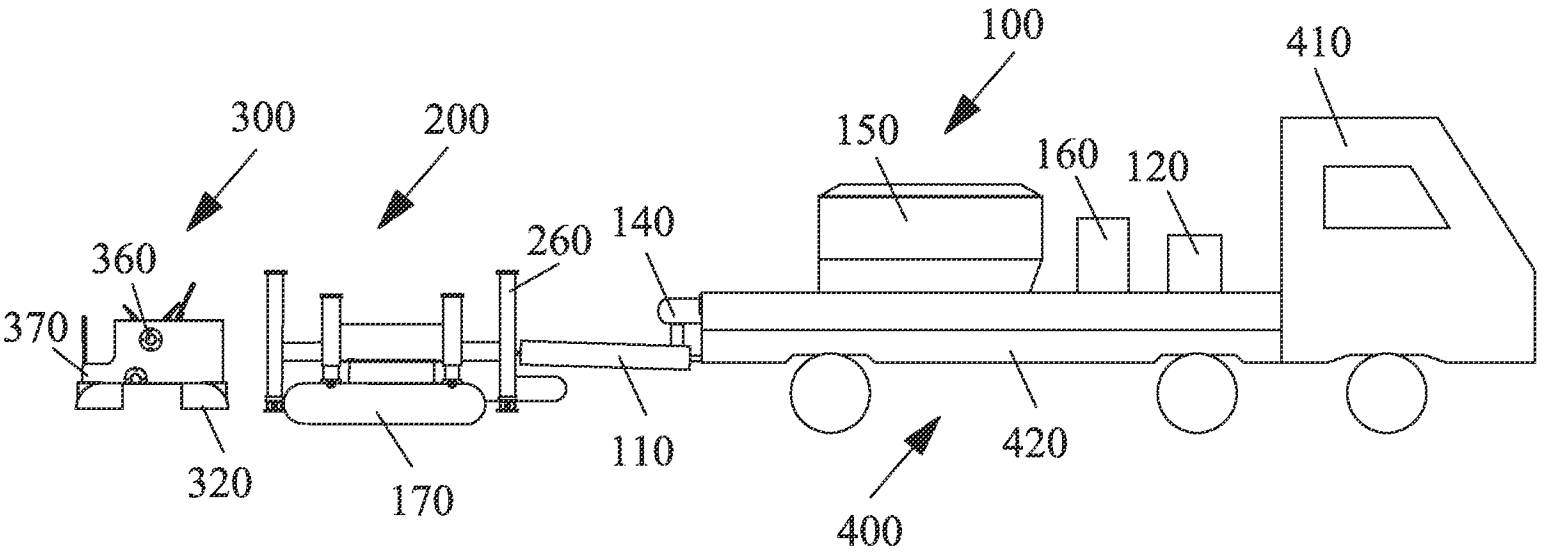
FIG. 1 is a front view of a road paver according to one example of the disclosure.

In the drawings, the following reference numbers are used: 100. Feeding device; 110. Stirring device; 111. Housing; 112. Rotating member; 113. Helical blade; 114. Stirring member; 120. Power system; 130. Transmission system; 140. Collecting system; 150. First measuring member; 160. Second measuring member; 161. Measuring box; 170. Caterpillar-type traveling mechanism; 200. Concrete paving device; 210. Feed hopper; 220. Concrete feed bin; 230. Unloading hopper; 240. Screed; 250. Screw conveyor; 260—Road grader; 270. Vibrator; 300. Stone paving device;

310; Stone feed bin; 320; Running gear; 330. Speed sensor; 340. Stone paver; 350. Paving roller; 360. Driving device; 370. Frame; 400. Road paver; 410. Head of road paver; and 420. Body.

DETAILED DESCRIPTION OF THE EMBODIMENTS

To further illustrate the disclosure, embodiments detailing a road paver are described below. It should be noted that the following embodiments are intended to describe and not to limit the disclosure.

Example 1

Figure 10:
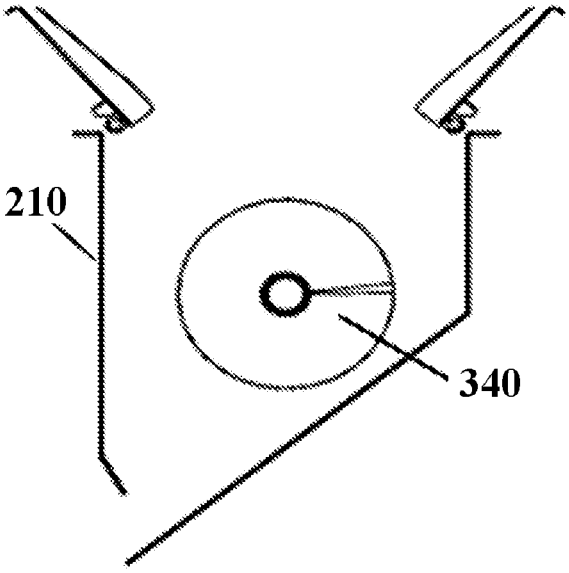
FIG. 10 is a side view of a stone feed bin according to one example of the disclosure.

As shown in FIG. 1, a road paver 400 comprises a chassis, a stirring device 110, a feeding device 100, a concrete paving device 200, and a stone paving device 300; the feeding device 100 is disposed on the chassis to hold and transport polyurethane concrete; the chassis is disposed in the front end to control rotation of the stirring device 110. The feeding device 100 comprises a rear end connected to the stirring device 110, and the concrete paving device 200 comprises a front end connected to the stirring device 110, so that the polyurethane concrete is transported from the feeding device 100 to the concrete paving device 200. The concrete paving device 200 comprises a bottom portion and a caterpillar-type traveling mechanism 170 disposed on the bottom portion; the caterpillar-type traveling mechanism 170 is a self-propelled and disposed on both sides of the concrete paving device 200 to drive the concrete paving device 200 to move in a single direction. The concrete paving device 200 comprises a rear end connected to the stone paving device 300. As shown in FIG. 10, the stone paving device comprises a stone feed bin 310; the stone feed bin 310 comprises a top opening for receiving the crushed stone, and a bottom opening through which the crushed stone is spread over a road; the top opening has a greater diameter than the bottom opening. In use, the polyurethane concrete is transported from the feeding device 100 to the concrete paving device 200 through the stirring device 110; the concrete paving device 200 spreads the polyurethane concrete across the road; and the stone paving device 300 spread the crushed stone over the polyurethane concrete.

The road paver 400 comprises a body 420 comprising a frame 370; the feeding device 100 is disposed on the frame and moves at the same speed as the body 420.

Example 2

Figure 5:
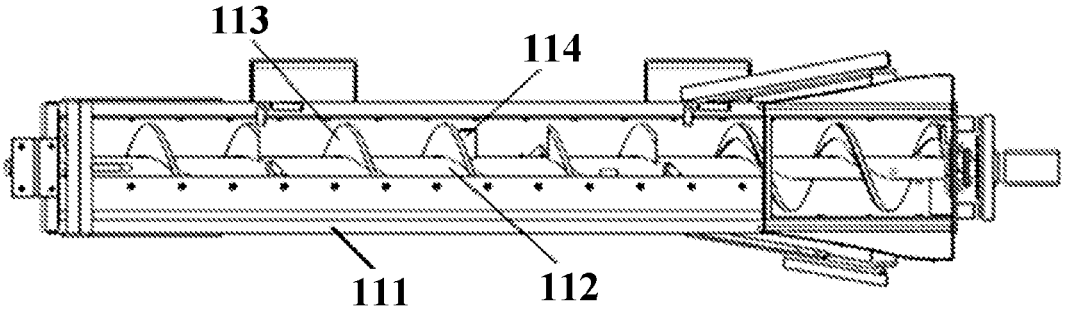
FIG. 5 is a top view of a stirring device according to one example of the disclosure.

As shown in FIG. 5, based on Example 1, the stirring device 110 further comprises a housing 111, a rotating member 112, at least two helical blades 113, and a stirring member 114. The housing 111 is in the shape of a cuboid with a top opening. The rotating member 112 is in the shape of a rod and comprises a first end near the feeding device 100; the first end is inserted into the housing 111 and connected to a power system 120; when the power system 120 is energized, the rotating member 112 rotates. The at least two helical blades 113 are spaced apart or connected together. The at least two helical blades 113 are bent into an arc of a circle and wrapped around the rotating member 112. The stirring member 114 is disposed between the at least two helical blades 113, vertically connected to the rotating member 112, and in the shape of a plate. In use, the feeding device 110 transports polyurethane concrete to the stirring device 110 for thorough mixing. The housing 111 is used to hold the polyurethane concrete. As the rotating member 112 rotates, the at least two helical blades 113 and the stirring member 114 rotates as well; the at least two helical blades 113 are bent into an arc of a circle, so that the polyurethane concrete is homogeneously mixed and pushed into the concrete paving device 200. The stirring member 114 thoroughly mixes the polyurethane concrete. The stirring device 110 has a certain length for thorough mixing of the polyurethane concrete.

Example 3

Figure 2:
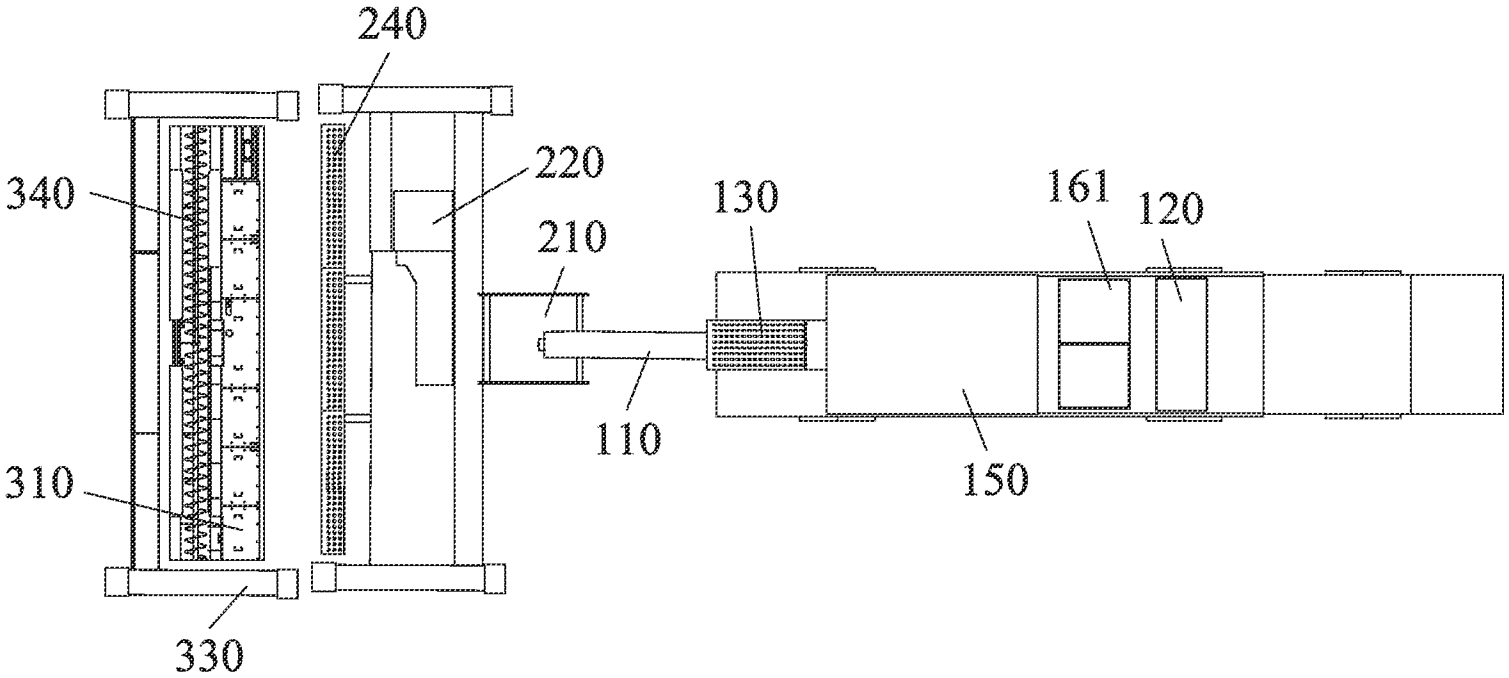
FIG. 2 is a top view of a road paver according to one example of the disclosure.
Figure 3:
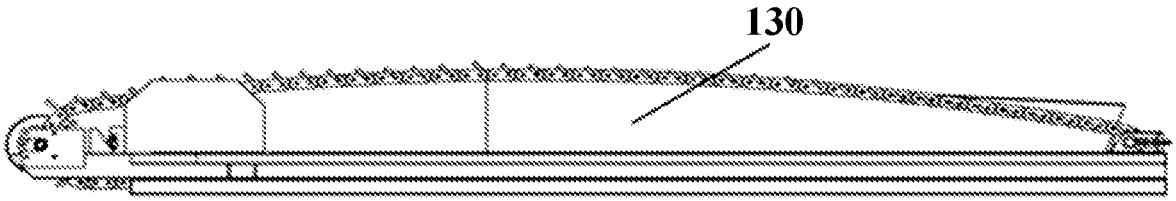
FIG. 3 is a front view of a transmission system according to one example of the disclosure.
Figure 4:
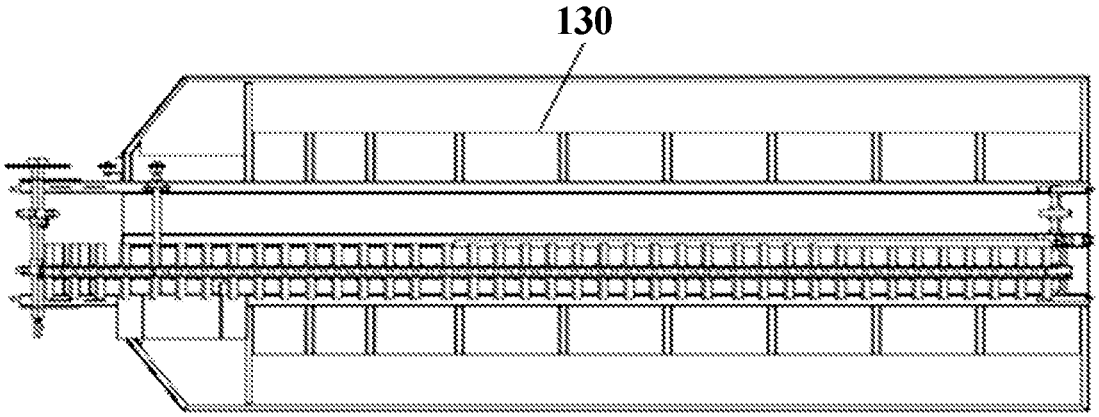
FIG. 4 is a top view of a transmission system according to one example of the disclosure.

As shown in FIG. 2, based on Example 1, the feeding device 100 further comprises a power system 120, a transmission system 130, and a collecting system 140. The power system 120 is in the shape of a cuboid and close to the head 410 of the road paver 400 for road pavement; and a motor is disposed in the power system 120 to power the feeding device 100. The transmission system 130 and the collecting system 140 are connected together and close to the stirring device 110. The transmission system 130 comprises three conveyor belts; as shown in FIG. 3, the three conveyor belts carries an aggregate to move forward. As shown in FIG. 4, the transmission system 130 has a certain width; the aggregate is placed on a middle conveyor belt; and the other two conveyor belts are disposed on both sides to receive the aggregate that falls from the middle conveyor belt. Both ends of the collecting system 140 are connected to the transmission system 130 and the stirring device 110, respectively. The collecting system 140 comprises a first open end and a second open end; the first open end is connected to the transmission system 130 and has a greater width than the three conveyor belts; and the second end is connected to the stirring device 110 and has a smaller width than the stirring device 110. In use, when the power system 130 is energized, the transmission system 130 transports the aggregate to the collecting system 140; the collecting system transports a certain amount of the aggregate to the stirring device at a specific speed. The collecting system comprises two pipes through which a certain amount of polyurethane is added to the stirring device, so that the aggregate and polyurethane are mixed in a proper ratio.

Example 4

Figure 7:
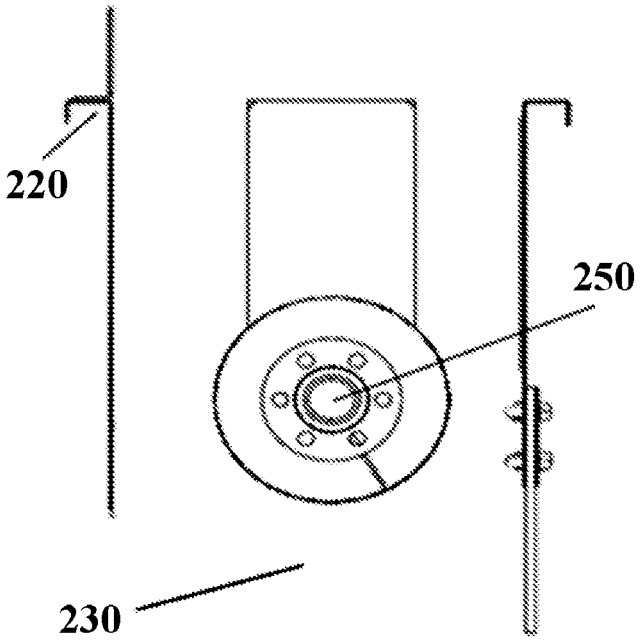
FIG. 7 is a side view of a concrete feed bin according to one example of the disclosure.

Based on Example 1, the concrete paving device 200 comprises a feed hopper 210, a concrete feed bin 220, an unloading hopper 230. As shown in FIG. 2, the feed hopper 210 is disposed below the stirring device 110; the stirring device 110 thoroughly mixes the polyurethane concrete and transports it to one end of the feed hopper 210; the feed hopper 210 comprises a conveyor belt on which the polyurethane concrete is carried to the concrete feed bin 220; the speed of the conveyor belt is varied with the rotation speed of the stirring device 110. As shown in FIG. 7, the unloading hopper 230 is disposed below the concrete feed bin 220 and has sides that slope at an angle; the unloading hopper 230 comprises a first end close to the feed hopper, and a second end away from the stone paving device 300; the first end has a greater length than the second end, which makes the thickness of the polyurethane concrete uniform. The concrete feed bin 220 comprises a first end and a second end; the first end is close to the stone paving device 300 and having a greater length than the second end, which prevents the polyurethane concrete from falling out of the concrete feed bin 220.

Example 5

Figure 9:
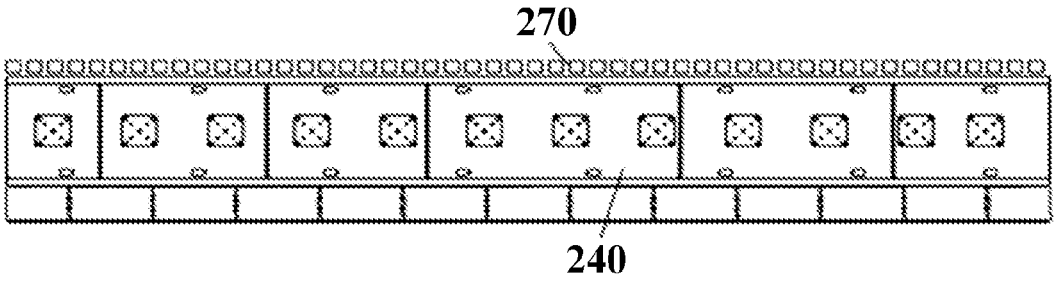
FIG. 9 is a top view of a screed according to one example of the disclosure.

Based on Example 4, as shown in FIG. 2, the road paver 400 further comprises a screed 240 and a vibrator 270; the screed is disposed on the rear end of the concrete paving device 200; the vibrator 270 is disposed above the screed. As shown in FIG. 9, the screed 240 is a flat rectangular plate that comprises a first side close to the unloading hopper 230; the vibrator 270 is disposed on the first side to compact the polyurethane concrete, thereby decreasing the air voids in the polyurethane concrete; and the screed 240 flattens the compacted polyurethane concrete.

Example 6

Figure 6:
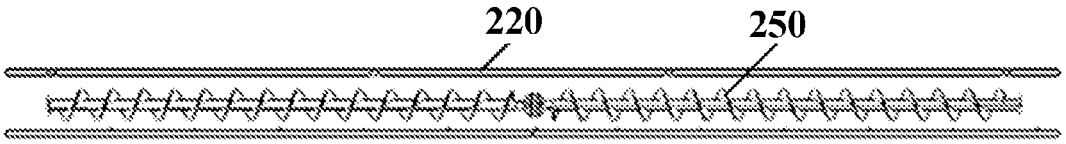
FIG. 6 is a top view of a concrete feed bin according to one example of the disclosure.
Figure 8:
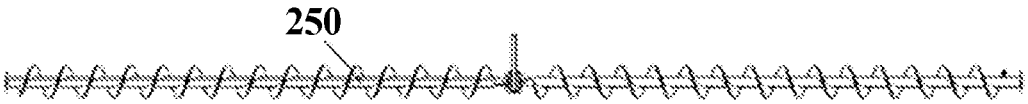
FIG. 8 is a perspective view of a screw conveyor according to one example of the disclosure.

Based on example 4, as shown in FIG. 6, the concrete paving device 200 further comprises a screw conveyor 250 disposed in the concrete feed bin 220. As shown in FIG. 8, the screw conveyor 250 comprises is in the shape of a rod with a plurality of helical blades. As shown in FIG. 7, the screw conveyor 250 is disposed in the middle of the concrete feed bin 220, so that the polyurethane concrete is divided into two parts and falls through a first channel and a second channel, respectively; the first channel is close to one side of the feeding device 100, and the second channel is close to the stone paving device 300; the polyurethane concrete falling through the first channel is spread across a road to form a base layer, and the polyurethane concrete falling through the second channel is then spread across the base layer, which decreases air void in the pavement structures.

Example 7

Based on Example 4, as shown in FIG. 1, the concrete paving device 200 further comprises a road grader 260; the road grader 260 comprises at least two balance columns disposed vertically on one side of the concrete paving device 200; the concrete paving device 200 is in the shape of a cubic; the at least two balance columns are used to balance the paving device 200 and flatten a road surface.

Example 8

Based on Example 1, as shown in FIG. 1, the stone paving device 300 further comprises a running gear 320; the running gear 320 comprises a power device and a clawer; the power device is used to provide power to the running gear 320, and the clawer is disposed parallel to the caterpillar-type traveling mechanism 170. As shown in FIG. 2, the stone paving device 300 further comprises a speed sensor 330 disposed on the running gear 320 to measure and control the operating speed of the running gear 320. The operating speed of the running gear is adjusted to control the amount of the crushed stone required per square foot. The stone paving device 300 further comprises a paving roller 350 used to control the amount of the crushed stone spread over the polyurethane concrete; when the speed sensor 320 works, the operating speed of the running gear 320 is regulated, thereby controlling the rotational speed of the paving roller 350.

Example 9

Figure 11:
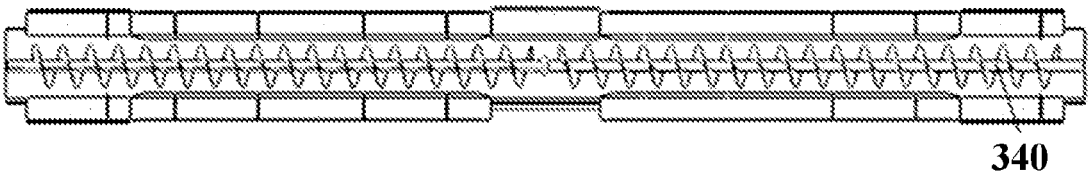
FIG. 11 is a top view of a stone feed bin according to one example of the disclosure.
Figure 12:
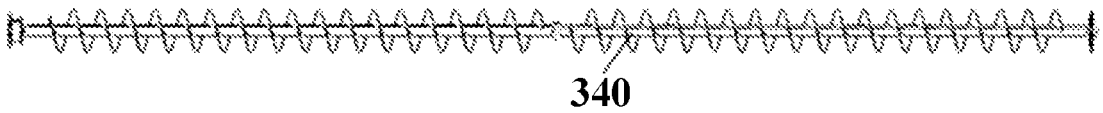
FIG. 12 is a perspective view of a stone conveyor according to one example of the disclosure.
Figure 13:
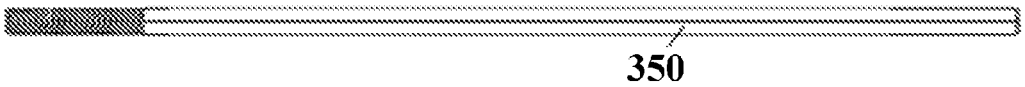
FIG. 13 is a perspective view of a paving roller according to one example of the disclosure.
Figure 14:
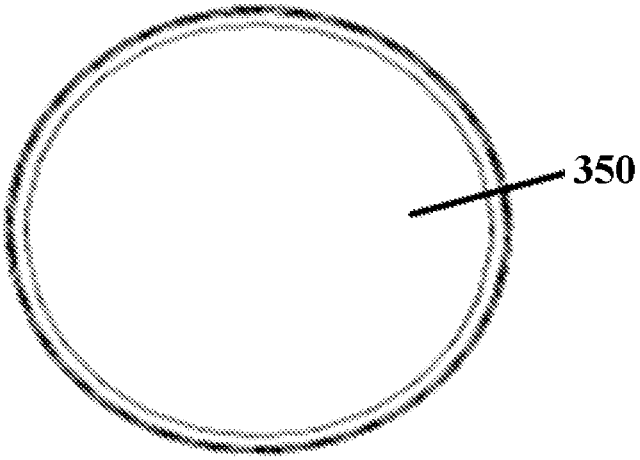
FIG. 14 is a side view of a paving roller according to one example of the disclosure.

Based on Example 1, the stone paving device 300 further comprises a stone conveyor 340, a paving roller 350, and a driving device 360. As shown in FIG. 11, the stone conveyor 340 is disposed in the middle of the stone feed bin 310. As shown in FIG. 12, the stone conveyor 340 is in the shape of a rod with a plurality of protrusions for thorough mixing of the crushed stone of different sizes. The paving roller 350 is disposed below the stone feed bin 310. As shown in FIG. 14, the paving roller 350 has a circular cross section. As shown in FIG. 13, the paving roller 350 is in the shape of a rod; the stone paving device 300 further comprises a casing; both ends of the paving roller 350 are connected to the casing to create an enclosed space.

Example 10

Based on Example 1, as shown in FIG. 1, the feeding device 100 further comprises a first measuring member 150 and a second measuring member 160; the first measuring member 150 is disposed between the power system 120 and the transmission system 130; and the second measuring member 160 is disposed between the first measuring member 150 and the power system 120. As shown in FIG. 12, the first measuring member 150 comprises a top opening and a bottom opening; the top opening is used to receive the aggregate; and the bottom opening is disposed above the transmission system 130. The second measuring member 160 comprises two measuring boxes 161 disposed in parallel and used to transport different types of polyurethane materials to the stirring device. The first measuring member 150 and the second measuring member 160 allows the stirring device to mix the polyurethane concrete in a construction site.

It will be obvious to those skilled in the art that changes and modifications may be made, and therefore, the aim in the appended claims is to cover all such changes and modifications.

What is claimed is:

1. A road paver, comprising:

a head;

a body comprising a front end and a tail end;

a feeding device, disposed in the front end to convey polyurethane concrete, and the feeding device comprising a stirring device;

a stone paving device, disposed on the tail end to spread crushed stone over a road, and the stone paving device comprising a stone feed bin carrying the crushed stone; and a concrete paving device, disposed between the feeding device and the stone paving device and connected to the stirring device, and used to spread the polyurethane concrete across the road;

wherein:

the feeding device further comprises:

a power system disposed on one side of the head of the road paver to power the feeding device;

a transmission system disposed on one side of the stirring device, and being driven by the power system to convey aggregates of the polyurethane concrete through a convey belt;

a collecting system, being connected to the stirring device and the transmission system and guiding the aggregates from the convey belt of the transmission system to the stirring device; and the collecting system comprises a first open end and a second open end; the first open end is connected to the transmission system and has a greater width than the convey belt of the transmission system; and the second end is connected to the stirring device and has a smaller width than the stirring device;

the concrete paving device comprises:

a feed hopper, disposed below the stirring device to receive the polyurethane concrete from the stirring device;

a concrete feed bin connected to the feed hopper to hold the polyurethane concrete; and an unloading hopper disposed below the concrete feed bin; and when in operation, the polyurethane concrete is laid down on the road via the unloading hopper; the unloading hopper comprises a first side close to the feed hopper and a second side close to the stone paving device; a distance between the first side and the road is less than a distance between the second side and the road.

2. The road paver of claim 1, wherein the stirring device comprises:

a housing, connected to the feeding device and used to receive the polyurethane concrete from the feeding device;

a rotating member, disposed in the housing;

at least two helical blades, used to stir and transport the polyurethane concrete; and a stirring member, disposed between the at least two helical blades to stir the polyurethane concrete; and the at least two helical blades and the stirring member are connected to the rotating member.

3. The road paver of claim 1, wherein the concrete paving device further comprises:

a screed, disposed on a rear end of the concrete paving device to flatten the polyurethane concrete; and a vibrator, disposed in front of the screed to compact the polyurethane concrete.

4. The road paver of claim 1, wherein the concrete paving device further comprises a screw conveyor disposed in the concrete feed bin to spread the polyurethane concrete across the road.

5. The road paver of claim 1, wherein the concrete paving device further comprises a road grader used to maintain a stable forward movement of the stone paving device.

6. The road paver of claim 1, wherein the stone paving device further comprises:

a running gear, disposed at a bottom portion of the stone paving device to carry the stone paving device to move; and a speed sensor, disposed on the running gear to measure and adjust an operating speed of the running gear.

7. The road paver of claim 1, wherein the stone paving device further comprises:

a stone conveyor, disposed in the stone feed bin to drive small rocks to move;

a paving roller, disposed below the stone conveyor to spread the crushed stone into the polyurethane concrete; and a driving device, disposed on a frame of the stone paving device and connected to the paving roller to drive the rotation of the paving roller.

8. The road paver of claim 1, wherein the feeding device further comprises:

a first measuring member, disposed between the power system and the transmission system to hold the aggregates; and the aggregates are transported into the stirring device through the transmission system; and a second measuring member, disposed between the first measuring member and the power system and comprising at least two measuring boxes used to hold polyurethane; and a certain amount of polyurethane is poured into the stirring device under control of the at least two measuring boxes.

* * * * *